US009566488B1

(12) United States Patent
Welch

(10) Patent No.: US 9,566,488 B1
(45) Date of Patent: Feb. 14, 2017

(54) GOLF CLUB CLEANER

(71) Applicant: John Welch, American Folk, UT (US)

(72) Inventor: John Welch, American Folk, UT (US)

( * ) Notice: Subject to any disclaimer, the term of this patent is extended or adjusted under 35 U.S.C. 154(b) by 296 days.

(21) Appl. No.: 14/301,265

(22) Filed: Jun. 10, 2014

Related U.S. Application Data

(60) Provisional application No. 61/833,220, filed on Jun. 10, 2013.

(51) Int. Cl.
*A63B 57/60* (2015.01)
*B08B 1/04* (2006.01)

(52) U.S. Cl.
CPC ..... *A63B 57/60* (2015.10); *B08B 1/04* (2013.01); *A46B 2200/3073* (2013.01)

(58) Field of Classification Search
CPC .. A63B 57/30; A63B 60/36; A46B 2200/3073
See application file for complete search history.

(56) References Cited

U.S. PATENT DOCUMENTS

| | | | | |
|---|---|---|---|---|
| 3,682,378 A * | 8/1972 | Rouan | G07B 17/00508 | 101/91 |
| 5,404,610 A * | 4/1995 | Coyer, Sr. | A63B 57/60 | 15/104.92 |
| 6,430,770 B1 * | 8/2002 | Glass | A63B 57/60 | 15/104.92 |
| 2007/0177928 A1 * | 8/2007 | Aarhaus | A46B 15/0055 | 401/123 |
| 2013/0036562 A1 * | 2/2013 | Smith | A46B 17/02 | 15/88.2 |

* cited by examiner

*Primary Examiner* — Nicole Blan
(74) *Attorney, Agent, or Firm* — Amy B. Fiene; James Sonntag

(57) ABSTRACT

A golf club cleaner includes a container and a cleaning unit with a free end spaced from a base of the container for a club face to be positioned and cleaned.

19 Claims, 5 Drawing Sheets

GOLF CLUB CLEANER

CROSS-REFERENCE TO RELATED APPLICATION

This application claims the benefit of priority of U.S. provisional application No. 61/833,220, filed Jun. 10, 2013, the contents of which are herein incorporated by reference.

BACKGROUND

The following relates to golf club cleaners. Engaging in the sport of golf invariably introduces factors of soil accumulating on heads of golf clubs. Soil deposits on a club face can affect the performance of a golf ball. Therefore, prompt removal of soil deposits after each golf club use may be desired to achieve optimal performance. Once a round of golf has been completed, golf clubs may again be cleaned to avoid corrosion from the retention of any remaining soil deposits.

Several methods of cleaning clubs exist. For example, there exists a traditional hand cleaning method. This method, however, may be tedious, time-consuming, and difficult, yielding generally unsatisfactory results. Introducing chemical cleaners to this method may merely result in damage to sensitive faces of many sophisticated club designs. This method is therefore not without its shortcomings.

Powered golf club cleaners also exist on the market. A typical example consists of long stationary bristles mounted vertically and submerged in a bucket of water. A club face is cleaned by scrubbing the club face against the bristles while submerged in the water. Using an up and down motion, the clubface is rubbed against the stationary bristles.

A problem with this method is that club face angles vary with respect to club shafts so scrubbing a club face in a vertical direction inside a container can be difficult. The larger the club face angle is with respect to the club shaft the more difficult it is to get the club face parallel with the scrubbing bristles. Moreover, it is not uncommon that club faces with increased angles not come in contact with the stationary bristles and therefore not be cleaned. Often, a handheld brush must be used in addition to the stationary bristles in order to remove all the debris from the club face grooves. Thus, the task may become taxing and arduous.

In summary, golf club cleaners often involve time and labor that lessen the relaxing effects and purposes intended by a game of golf.

SUMMARY

A golf club cleaner may include a brush that rotates in a fluid-filled container, the brush having a free end spaced from an end of the container, the space allowing club faces with various angles to be slidably immersed in the container, fit under the free end of the brush and be cleaned as the brush rotates.

DETAILED DESCRIPTION

Figure 1:
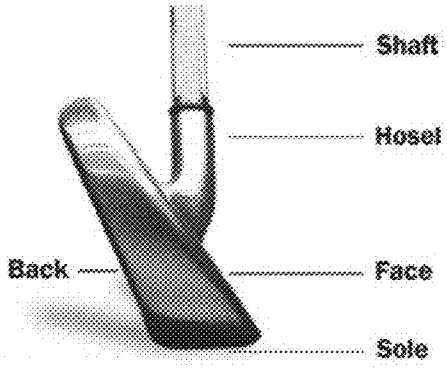
FIG. 1 shows a front view of a portion of a golf club.
Figures 2A, 2B, 2C, 2D, 2E, 2F, 2G, 2H:
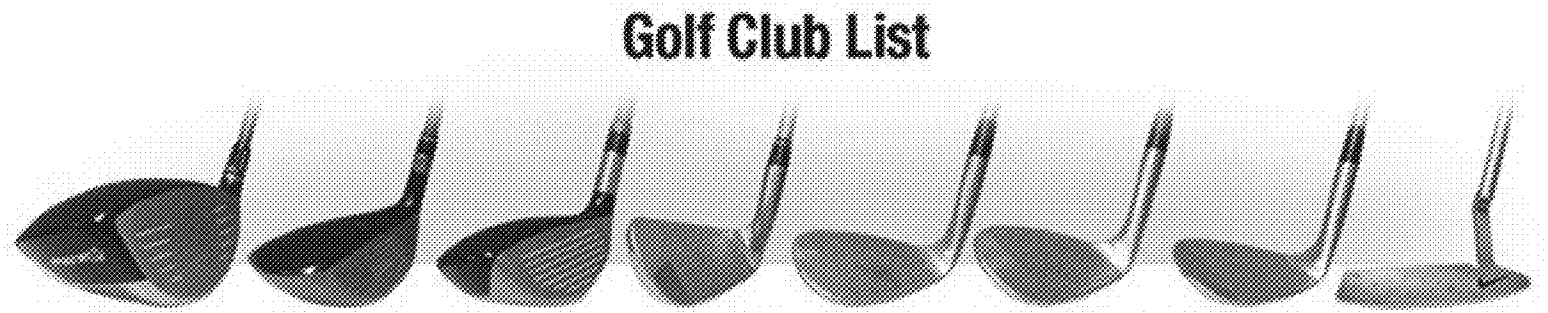
FIGS. 2*a*-2*h* show golf clubs with various club face angles and dimensions.

The following relates to a golf cleaner. Turning to FIG. 1, a portion of a golf club is shown, with references to the SHAFT, HOSEL, BACK, FACE, and SOLE. During a game of golf, these portions of a golf club are subject to accumulation of dust and dirt, and may prove difficult or tedious to clean in between golf swings. As indicated by the references, portions that may need cleaning may include the SHAFT, HOSEL, BACK, FACE, and SOLE.

Turning to FIGS. 2*a*-2*h*, a variety of golf clubs are shown, each having a different face angle and dimensions. These types of differences make reaching contact surfaces for cleaning a challenge, particularly when using a golf cleaner.

Figure 4:
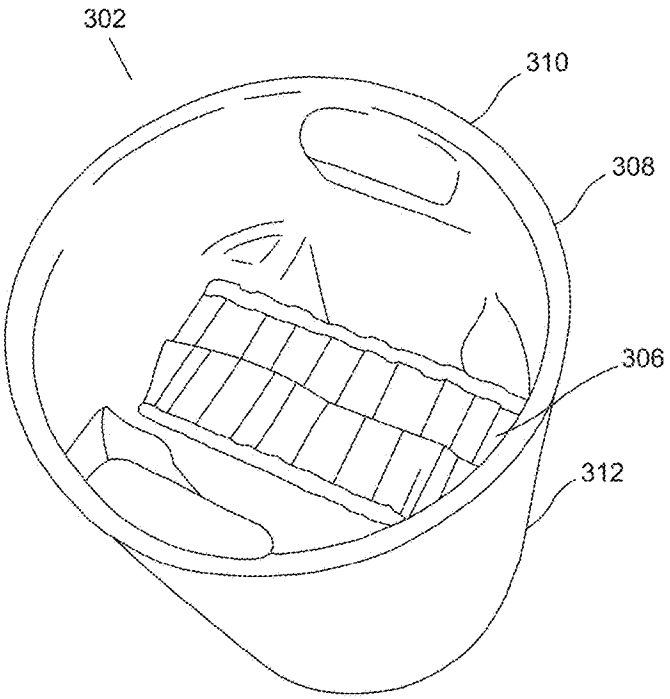
FIG. 4 shows another perspective view of a common golf club cleaner.
Figure 3:
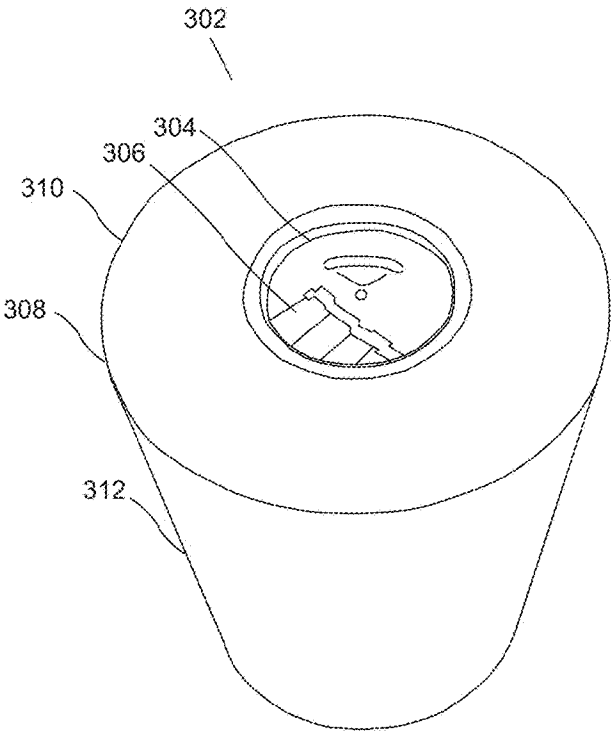
FIG. 3 shows a perspective view of a common golf club cleaner.

Turning to FIGS. 3 and 4, perspective views of a common golf cleaner 302 are depicted, including a container 308, side walls 312, lid 310, dual vertical brushes 306, and insert hole 304. The dual vertical brushes 306 are attached at ends to side walls 312 of the container 308. The dual vertical brushes 306 are typically immersed in a fluid, such as water or a cleaning fluid. At the top of the container 308 is a lid 310 with an insert hole 304. A golf club is inserted into the insert hole 304 and pushed between the dual vertical brushes 306. The golf club can then be cleaned by using an up and down motion, causing the dual vertical brushes to brush against parts of the gold club. Alternatively, the dual vertical brushes may be powered and rotate automatically such that the inserted golf club is brushed and cleaned by the rotating brushes. In such a case, the golf club may be held in place or moved up and down.

With rotating or stationary brushes, however, the golf club may not be cleaned to satisfaction given that the insert hole 304 and the dual vertical brushes 306 restrict positioning of the golf club. Golf clubs with wide angle faces, such as wedge faces, are difficult to clean because the golf club cannot be angled to make the face be vertical, or in other words, parallel to the dual vertical brushes 306. Thus, the vertical brushes may not be able to engage the entire surface of the face of the golf club. In particular, the FACE may have varying degrees of angles, making a FACE with large angles difficult for vertical brushes in common golf cleaners to contact, let alone clean.

Figure 5:
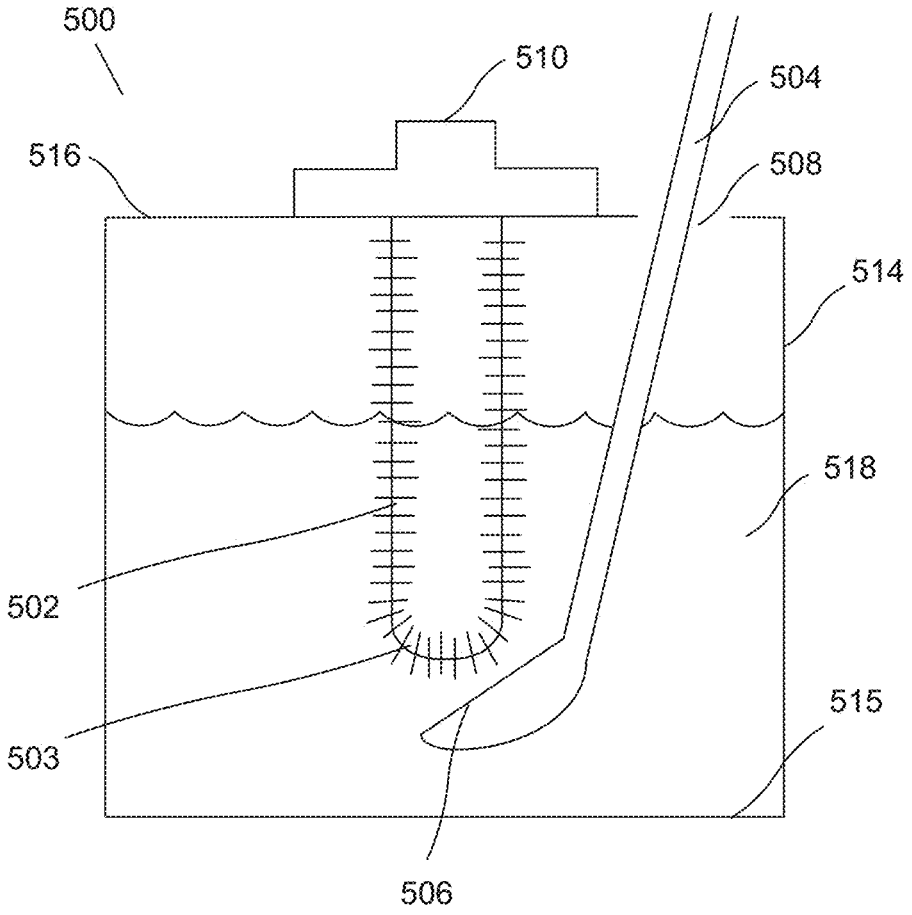
FIG. 5 shows a cutout side view of a golf club cleaner with a brush free end.

Turning to FIG. 5, a golf cleaner 500 is shown, including brush 502 with free end 503, golf club 504, club face 506, insert hole 508, motor 510, fluid 512, container 514, base 515, lid 516, and fluid 518. The container 514 may be a lightweight, portable unit that holds fluid 518, such as water or cleaning fluid. The container 514 may include lid 516 on top of the container 514 as a covering for the container 514. The lid 516 may include or be attached to motor 510. Also, the lid 516 may include insert hole 508, a generally rounded opening or slot that allows a golf club 504 to be inserted. Also attached to the lid 516 or motor 510 is brush 502 with free end 503. Instead of a brush, a cleaning unit or mechanism may be used. The mechanism may have moving parts or stationary elements that assist in cleaning a club head. As shown, the brush 502 may be immersed in the fluid 518.

Optimal cleaning may be achieved by positioning the end of the brush 502 with free end 503 at a distance from a base 515 of the container. The distance from the base 515 helps provide adequate space for the face 506 of the golf club 504 to be positioned. Note that the free end 503 is rounded or curved so that the face 506 of the golf club 504 may be adjusted or moved as desired to achieve contact and scrubbing. Other configurations are anticipated. For example, the brush 502 may be tapered or have bristles that are tapered. Bristles may have various lengths or patterns to achieve optimal contact. Also, there may be multiple vertical brushes. Instead of being vertical as shown, the brush 502 may be angled or horizontal brushes may be used.

Movement of the golf club 504 is further facilitated by the insert hole 508 being large enough to enable adjustment and movement as desired.

To rotate the brush 502, a motor attached to the lid 516 or container 514 may be used. For example, the motor 510 may be electric, battery-powered, gas-powered, pneumatic, etc. Alternatively, there may be no motor. Rotation may be achieved with a hand crank or with another turning mechanism. Also note that the brush may be stationary with cleansing achieved by hand movement of the golf club.

Because the cleaner may be compact and portable, it may be easily transported in a golf cart or other vehicle. Also, it may be a plug-in or stand-alone unit.

Figure 6:
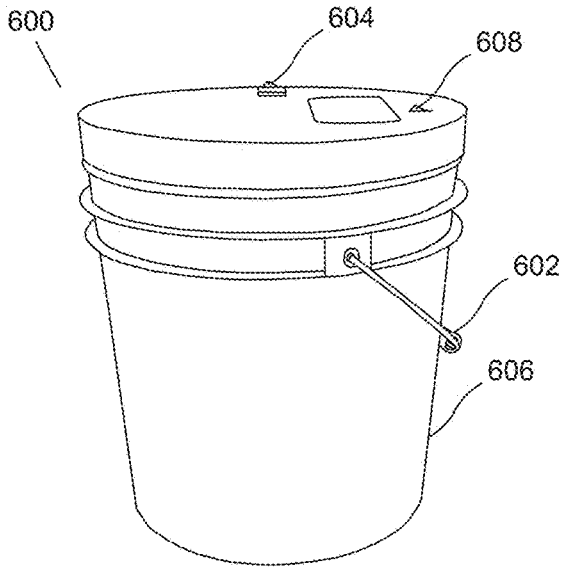
FIG. 6 shows a perspective view of a golf club cleaner and a brush free end.

Turning to FIG. 6, a golf club cleaner 600 is shown including a handle 602, switch 604, bucket 606, and lid 608. Embodiments include a bucket-like handle for carrying the golf club cleaner 600. Other types of handles may also be used. For example, hand grips on the sides of the bucket 606 may be present. Other kinds of grips or handles may be used.

To turn the motor 510 on and off, the switch 604 may be included on the lid 608 or on the sides of the bucket 606. Other common controls may be used. For example, the motor may include a trip mechanism that engages the motor.

Figure 7:
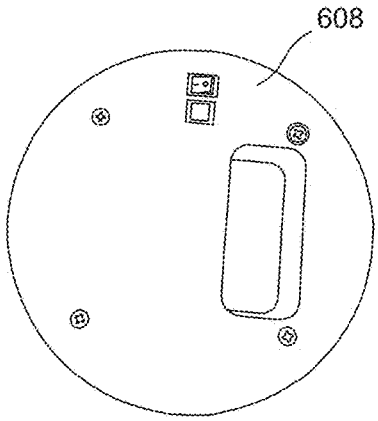
FIG. 7 shows a perspective view of a top of a golf club cleaner.
Figure 8:
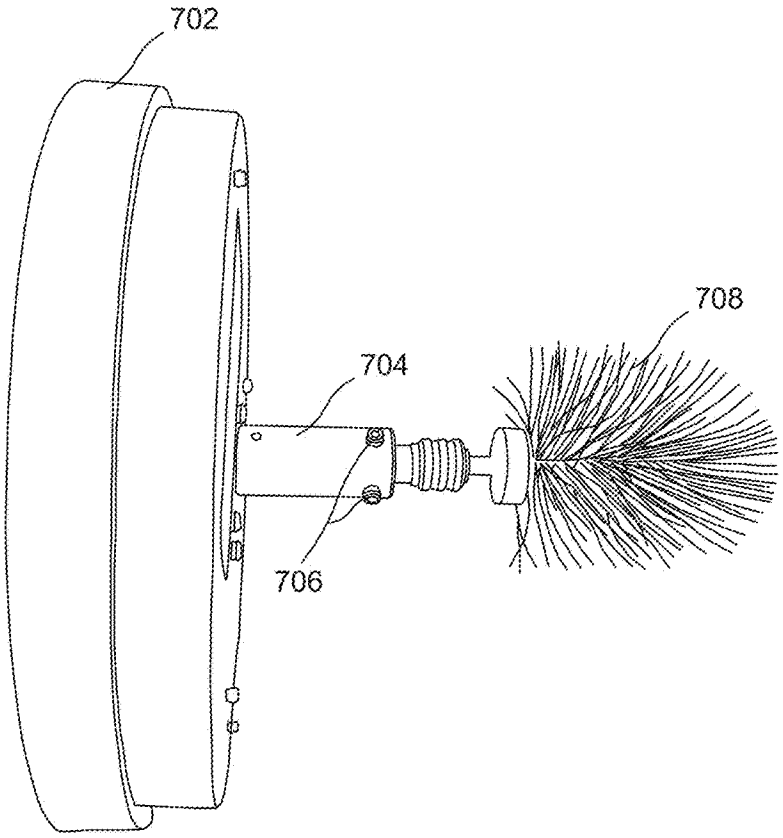
FIG. 8 shows a side view of a top of a golf club cleaner and a brush free end.

Turning to FIG. 7, the lid 608 is shown separate from the bucket in FIG. 8. Embodiments include that the lid 608 be removable. This allows the water or fluid to be removed and replenished, a brush to be replaced, the interior of the bucket 606 or container 514 to be cleaned, and the motor 510 to be repaired or replaced. Other advantages may be discerned.

Turning to FIG. 8, a side view of a lid 702, arm 704, screws 706, and brush 708 are shown. The brush 708 may be removable. As shown, embodiments include that the brush 708 be attached to arm 704 of the lid 702 by screws 706. Friction-fit, release mechanisms, and other types of securement are anticipated. The brush 708 may be threaded and screwed into the arm 704. Attachment may be removable or unremovable. Removable brushes may be advantageous to extend the life of the golf cleaner and allow for different types of brushes to be used as desired.

While reference has been made to certain specific embodiments and examples, it will be recognized by those skilled in the art that many variations are possible without departing from the scope and spirit of the description, and that the claims are intended to cover all changes and modifications of the embodiments which do not depart from the spirit of the description presented herein.

I claim:

1. A golf club cleaner comprising;

a container with a lid, the lid providing a top opening that is radially offset from a central axis of the container and adapted to receive a golf club; and a rotatable cleaning unit centrally positioned within the container and disposed vertically downward within the container, the cleaning unit having a rounded free end spaced from a base of the container, the container configured for the golf club to extend through the top opening and vertically downward within the container, the free end and the container configured to allow sufficient contact of the free end with a face of the golf club for cleaning the face.

2. The golf club cleaner in claim 1, wherein the lid is removable.

3. The golf club cleaner in claim 2, wherein the cleaning unit is removably attached to the removable lid.

4. The golf club cleaner in claim 3, wherein a release mechanism removably attaches the cleaning unit to the removable lid.

5. The golf club cleaner in claim 1, further comprising a motor that rotates the cleaning unit.

6. The golf club cleaner in claim 5, wherein the cleaning unit is removably attached to the motor.

7. The golf club cleaner in claim 6, wherein a release mechanism removably attaches the cleaning unit to the removable lid.

8. The golf club cleaner in claim 5, further comprising a switch for controlling the motor.

9. The golf club cleaner in claim 5, further comprising a trip mechanism that engages the motor.

10. The golf club cleaner in claim 1, further comprising a hand crank that rotates the cleaning unit.

11. The golf club cleaner in claim 1, wherein the cleaning unit is a brush.

12. The golf club cleaner in claim 1, wherein the space from the base includes dimensions adapted to receive a club face.

13. The golf club cleaner of claim 1, including that the free end and the container are configured to allow contact of the free end with a face of the golf club sufficient for cleaning the face, the golf club being any one of putter, wedge, iron, hybrid, fairway, or driver.

14. A method for cleaning a golf club, comprising:

inserting a golf club into an opening that is located on top of a container, the opening being offset from a central axis of the container, the container including a cleaning unit with a rounded free end, the cleaning unit being centrally located and extending vertically downward within the container;

lowering a club face of the golf club underneath the cleaning unit to a space between an end of the cleaning unit and a base of the container;

angling the golf club with respect to a vertical axis in order to contact the rounded free end; and rubbing the club face against the cleaning unit.

15. The method in claim 14, further comprising a motor that rotates the cleaning unit.

16. The method in claim 14, further comprising a hand crank that rotates the cleaning unit.

17. The method in claim 14, wherein the cleaning unit is a brush.

18. The method in claim 14, wherein the cleaning unit is removably attached.

19. A golf club cleaner comprising;

a container with a lid on top, a slotted opening provided by the lid that is radially offset from a central axis of the container, the opening adapted to receive a golf club;

a rotatable cleaning unit centrally positioned on the lid, the cleaning unit attached to the lid, the cleaning unit disposed vertically downward along the central axis within the container, the cleaning unit having a free end spaced from a base of the container, the free end comprising a single brush with bristles that extend radially outward from the brush;

the container configured for the golf club to extend through the opening vertically downward within the container, the brush of the container configured to allow sufficient contact of the brush with a face of the golf club for cleaning the face, the opening having a sufficient offset from the rotatable cleaning unit and is of a sufficient size for angling a shaft of the golf club with respect to the central axis to allow the sufficient contact of the brush where the brush is capable of cleaning at any face angle near 0 degrees and near 60 degrees;

a motor centrally located on the lid and attached to the brush such that it axially rotates the brush within the container.

* * * * *